United States Patent [19]

Klüttermann

[11] Patent Number: 4,691,414

[45] Date of Patent: Sep. 8, 1987

[54] SLIVER COILER DRIVE

[75] Inventor: Jürgen Klüttermann, Monchen-Gladbach, Fed. Rep. of Germany

[73] Assignee: Trützschler GmbH & Co. KG, Monchen-Gladbach, Fed. Rep. of Germany

[21] Appl. No.: 879,064

[22] Filed: Jun. 26, 1986

[30] Foreign Application Priority Data

Jul. 10, 1985 [DE] Fed. Rep. of Germany ..... 3524601

[51] Int. Cl.[4] ..... B65H 54/80

[52] U.S. Cl. ..... 19/159 R

[58] Field of Search ..... 19/159 R, 159 A, 157

[56] References Cited

U.S. PATENT DOCUMENTS

| | | | |
|---|---|---|---|
| 2,018,261 | 10/1935 | Holdsworth . | |
| 2,745,146 | 5/1956 | Wilkie | 19/159 R |
| 2,810,936 | 10/1957 | Altenburger | 19/159 R X |
| 3,402,433 | 9/1968 | Schwalm | 19/159 R |
| 3,426,391 | 2/1969 | Whitehurst | 19/159 R |
| 4,545,093 | 10/1985 | Jagst | 19/159 R |

FOREIGN PATENT DOCUMENTS

| | | | |
|---|---|---|---|
| 2802216 | 7/1979 | Fed. Rep. of Germany . | |
| 794445 | 5/1958 | United Kingdom . | |
| 845894 | 8/1960 | United Kingdom . | |
| 888310 | 1/1962 | United Kingdom | 19/159 R |
| 1079742 | 8/1967 | United Kingdom . | |

*Primary Examiner*—Werner H. Schroeder
*Assistant Examiner*—J. L. Olds
*Attorney, Agent, or Firm*—Spencer & Frank

[57] ABSTRACT

A sliver coiler includes a coiler head supported for rotation about a generally vertical axis; a sliver depositing arrangement carried by the coiler head eccentrically relative to the axis and arranged for receiving sliver from above and discharging sliver downwardly during rotation of the coiler head; a pair of cooperating pressure rollers supported for rotation stationarily upstream of the sliver depositing arrangement as viewed in a running direction of the sliver passing between the pressure rollers; and a drive including a rotatably supported power-driven shaft and first and second drive elements for the coiler head and the pressure rollers, respectively. The first and second drive elements are operatively connected with the power-driven shaft. The first drive element is mounted on the power-driven shaft, and a transmission element connects the first drive element with the coiler head.

7 Claims, 4 Drawing Figures

SLIVER COILER DRIVE

BACKGROUND OF THE INVENTION

This invention relates to a device for driving a sliver coiler which is associated with a carding machine or a roller card unit and which includes a rotary coiler can, a coiler head, a sliver conduit and stationarily supported pressure rollers. The driving device includes a driven shaft coupled to a separate drive element for the coiler head and the pressure rollers.

In a known sliver coiler of the above-outlined type the drive for the coiler head and the pressure rollers is branched in a multiple manner and has a plurality of drive elements. In this arrangement, among others, a plurality of gearings are needed; this leads to gearing losses and thus to a reduction of the efficiency of the sliver coiler.

SUMMARY OF THE INVENTION

It is an object of the invention to provide a sliver coiler of the above-outlined type which, in particular, provides an improved drive for the coiler head and the pressure rollers, resulting in an increased efficiency of the sliver coiler.

This object and others to become apparent as the specification progresses, are accomplished by the invention, according to which, briefly stated, the drive element for the coiler head is mounted on the driven shaft and is coupled with the coiler head by a transmission element.

According to a further feature of the invention, the drive element for the pressure rollers is mounted on the driven shaft and is coupled by means of a transmission element with at least one of the pressure rollers.

The mutual arrangement of driving elements and driven elements according to the invention involves the use of a very small number of power train branches, whereby mechanical losses attributable to intermediate drives and the like are eliminated. It is a particular advantage of the invention that the coiler head and/or the pressure rollers may be driven by the transmission element directly, that is, without intermediate elements and thus may be driven without power transmission losses which would result from an indirect drive. In this manner, the efficiency of the sliver coiler is increased. The drive elements are reduced to a small number which is an additional advantage as concerns manufacture and storage. It is a further advantage of the invention that noise generation is also reduced. As the central driving unit a stationarily mounted conventional drive with a minimum number of shafts may be used; in this manner, only small masses need to be moved and the drive is furthermore relatively silent.

According to a further feature of the invention, the drive element for the pressure rollers is coupled with both pressure rollers. Expediently, the drive element is a belt pulley and the transmission element is a drive belt. This arrangement ensures a silent power transmission which needs no maintenance. Advantageously, the drive element is a sprocket and the transmission element is a toothed belt to ensure a slip-free transmission. Expediently, at least one idler pulley is provided for tensioning the friction belt or toothed belt. Expediently, on the driven shaft there is mounted a further drive element which effects the rotary motion of the coiler can and which is connected by a transmission element with the drive for the rotary platform on which the coiler can is removably positioned. Preferably, the additional drive element associated with the coiler can comprises a worm gear and the transmission element is a shaft, one end of which carries a pinion meshing with the worm gear and the other end of which carries a belt pulley or a sprocket for a toothed belt. According to a further feature of the invention, between the pinion and the shaft a stepping gear is interposed for increasing or reducing the transmission ratio. In this manner, the rotary speed of the coiler can may be varied and thus a fine correction of the coils of the sliver deposited in the can may be effected. Also, by means of such stepping gear the rotation of the coiler can may be reversed.

DESCRIPTION OF THE PREFERRED EMBODIMENTS

Figure 1A:
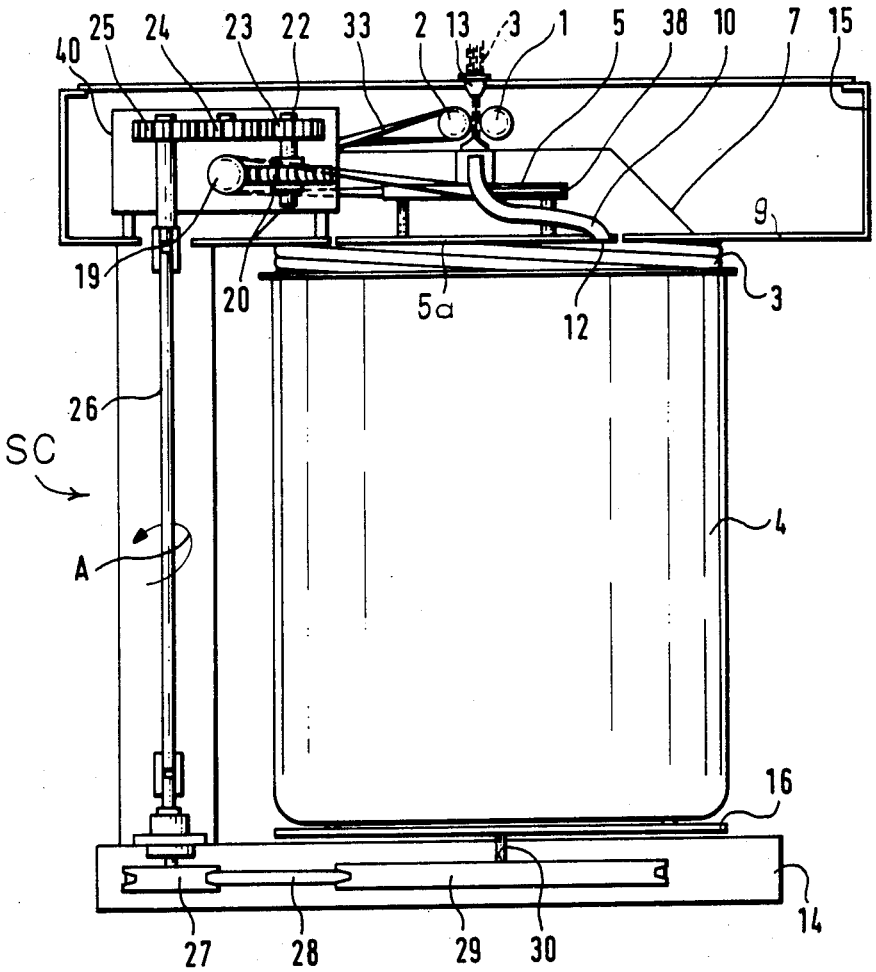
FIG. 1*a* is a schematic sectional side elevational view of a preferred embodiment of the invention.

Turning now to FIG. 1*a*, there is illustrated therein a sliver coiler generally designated at SC, supporting a removable coiler can 4. The sliver coiler SC includes two pressure rollers 1 and 2 which advance the sliver 3 downwardly as it passes therebetween. The pressure rollers form part of a fiber preparing (processing) machine, such as a carding machine, or a roller card unit which handles long-staple or short-staple fiber material and which is equipped with the sliver coiler depositing the sliver 3 into the coiler can 4. The horizontal, stationarily supported pressure rollers 1 and 2 deliver the sliver 3 at a high speed of up to 1000 m/min. for depositing the sliver in uniform coils into the can 4 which is rotated during the fiber deposition.

Figure 1B:
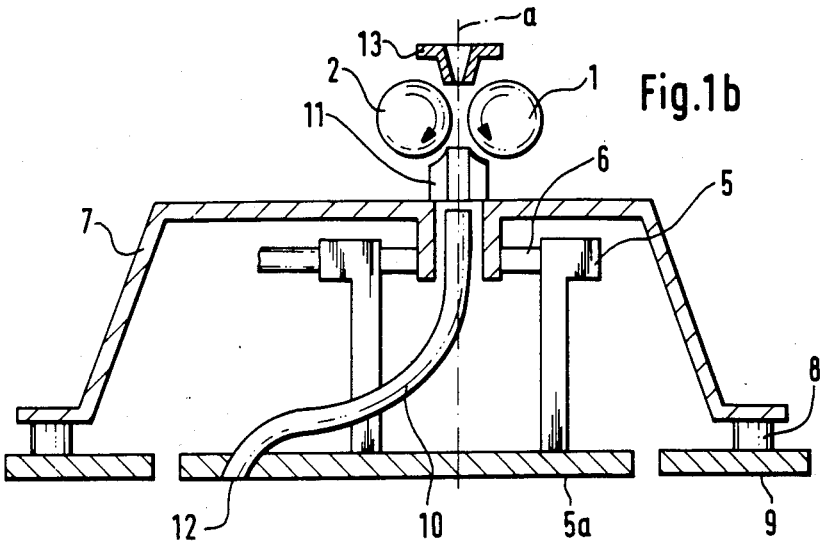
FIG. 1*b* is a sectional elevational view, on an enlarged scale, of further details of the structure of FIG. 1*a*.

Also considering now FIG. 1*b*, a coiler head 5 is suspended from a carrier 7 and is rotatably supported by means of a roller bearing 6 for rotation about a generally vertical axis a. The coiler head 5 includes a hose-like sliver conduit or channel 10 which has an upstream end with which there is aligned an upstream-arranged stationary inlet piece 11 arranged coaxially with the axis a and secured to the carrier 7. The sliver channel 10 extends obliquely downwardly and terminates in the underside 5*a* of the coiler head 5 to present a discharge opening 12 therein, in the vicinity of the periphery of the underside 5*a*. Along its major portion, down to the outlet opening 12, the sliver channel has a generally S-shaped, curved configuration. A sliver trumpet 13 is stationarily supported upstream of the pressure rollers 1 and 2, in alignment with the rotary axis a.

The machine frame of the sliver coiler SC described above includes an elongated base plate 14 and a head casing 15 which is arranged vertically above the base plate 14 at a predetermined distance therefrom. The underside 5*a* of the coiler head 5 is oriented essentially coplanar with the underside 9 of the head casing 15. The stationary carrier 7 is secured to the inside top face of the underside 9 by mounting components 8.

During normal operation of the sliver coiler SC, the pressure rollers 1 and 2 are driven such that the sliver 3 which is fed to the coiler head 5 is deposited in the can 4 supported on a platform 16 situated immediately above the base plate 14. The platform 16 is rotated together with the can 4 situated thereon as the coiler head 5 rotates and the orbiting outlet 12 discharges the sliver into the coiler can 4. As the latter is filled, the upper deposited sliver loops project beyond the upper can edge—as illustrated in FIG. 1*a*—whereby the deposited sliver mass, by virtue of the inherent elasticity of the sliver 3 and/or by virtue of the bias of an upwardly displaceable can bottom, is pressed against the underside 5*a* of the rotary head 5 and the underside 9 of the head casing 15.

Figure 1C:
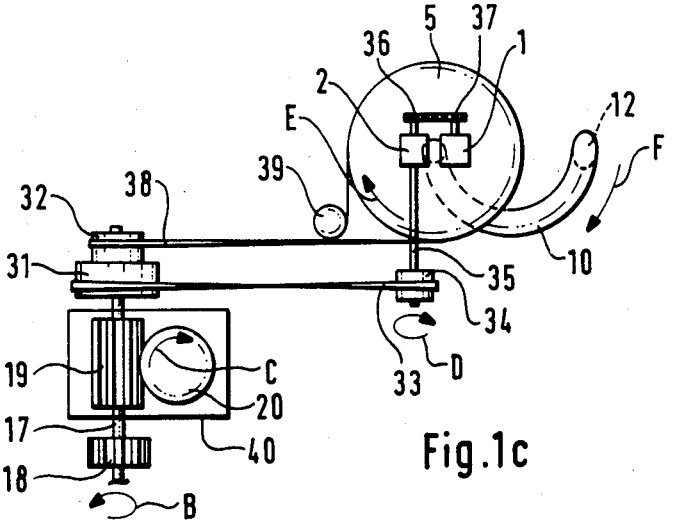
FIG. 1*c* is a schematic top plan view of one part of the construction shown in FIG. 1*a*.

Turning now in particular to FIG. 1*c*, within the head casing 15 there is arranged a generally horizontal shaft 17, to one end of which there is keyed a driving wheel 18 (gear, pulley or the like) connected to a motor or power gearing (not shown) for driving the shaft 17. To the power-driven shaft 17 there is further secured a worm gear 19 which meshes with a pinion 20. Also reverting to FIG. 1*a*, the pinion 20 is keyed to a shaft 22 which also carries a spur gear 23, meshing with a spur gear 24 which, in turn, meshes with a spur gear 25. The latter is mounted at the end of a shaft 26 whose other end carries a belt pulley 27 which drives a further belt pulley 29 by means of a V belt 28. The pulley 29 is mounted on a vertical shaft 30 whose upper end supports the horizontally oriented rotary platform 16. The gears 23, 24, 25 form an appropriate step-down or step-up gearing. It is also feasible to mount the pinion 20 directly on the shaft 26, in which case the shaft 22 and the gears 23, 24 and 25 are dispensed with.

As shown in FIG. 1*c*, on the shaft 17 there are further mounted belt pulleys 31 and 32. The belt pulley 31 drives, by means of a belt 33, a belt pulley 34 which is mounted at one end of a shaft 35. The latter, in turn, supports the pressure roller 2 as well as a gear 36 which meshes with a gear 37 coaxially connected with the pressure roller 1. In this manner, both pressure rollers 1 and 2 are positively driven. The belt pulley 32 drives the coiler head 5 by a belt 38 which is tensioned by an idler pulley 39.

Arrows A–H illustrate the respective directions of rotation of the various rotary components described. A housing for the drive unit—which, among others, encloses the shaft 17, the worm gear 19 and the pinion 20—is designated at 40.

Figure 2:
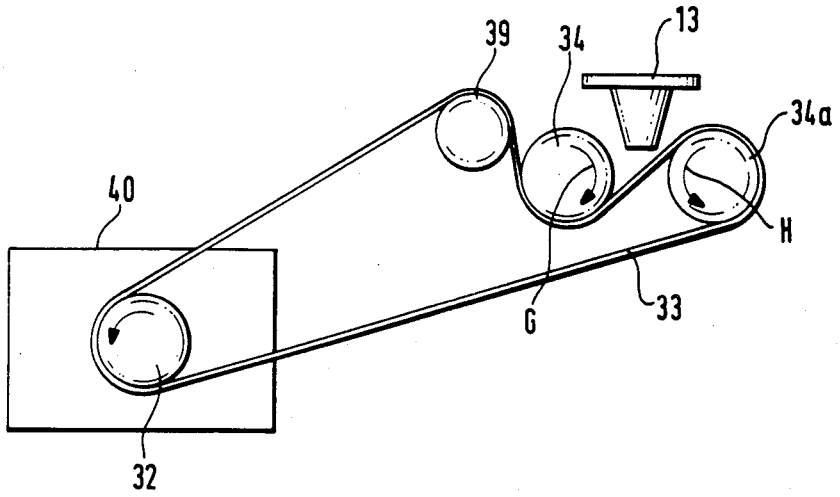
FIG. 2 is a schematic side elevational view of a further preferred embodiment of the invention.

Turning now to FIG. 2, there is shown an embodiment wherein the belt 33 is looped around the pulley 34 and a pulley 34*a*. This arrangement serves for driving the pressure rollers 1 and 2 directly by the belt 33 without the intermediary of gears 36 and 37 of the FIG. 1*c* construction.

The present disclosure relates to subject matter contained in Federal Republic of Germany Patent Application No. P 35 24 601.4 (filed July 10th, 1985) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a sliver coiler including a coiler head supported for rotation about a generally vertical axis; a sliver depositing means carried by said coiler head eccentrically relative to said axis and arranged for receiving sliver from above and discharging sliver downwardly during rotation of the coiler head; a pair of cooperating pressure rollers supported for rotation stationarily upstream of the sliver depositing means as viewed in a running direction of the sliver passing between said pressure rollers; a rotatably held platform situation underneath said coiler head at a vertical distance therefrom for supporting a coiler can into which sliver running downwardly from said coiler head is deposited; and drive means including a rotatably supported power-driven shaft and first and second drive elements for said coiler head and said pressure rollers, respectively; said first and second drive elements being operatively connected with said power-driven shaft; the improvement wherein said first drive element is mounted on said power-driven shaft; the improvement further comprising a transmission element connecting said first drive element with said coiler head; a third drive element mounted on said power-driven shaft; a first additional shaft operatively connecting said third drive element with said rotary platform; a second additional shaft; said third drive element including a worm gear mounted on said power-driven shaft and a pinion mounted on said second additional shaft and meshing with said worm gear; a transmission ratio-changing gearing mounted on said first and second additional shafts and meshing with said pinion for drivingly connecting said pinion to said first additional shaft; first wheel means mounted on said first additional shaft at a distance from said transmission ratio-changing gearing; second wheel means coaxially and rigidly connected with said platform; and an endless belt trained about said first and second wheel means.

2. A sliver coiler as defined in claim 1, wherein said second transmission element is an additional shaft; said third drive element comprises a worm gear mounted on said power-driven shaft and a pinion mounted on said additional shaft and meshing with said worm gear; first wheel means mounted on said additional shaft at a distance from said pinion; second wheel means coaxially and rigidly connected with said platform; and an endless belt trained about said first and second wheel means.

3. In a sliver coiler including a coiler head supported for rotation about a generally vertical axis; a sliver depositing means carried by said coiler head eccentrically relative to said axis and arranged for receiving sliver from above and discharging sliver downwardly during rotation of the coiler head; a pair of cooperating pressure rollers supported for rotation stationarily upstream of the sliver depositing means as viewed in a running direction of the sliver passing between said pressure rollers; and drive means including a rotatably supported power-driven shaft and first and second drive elements for said coiler head and said pressure rollers, respectively; said first and second drive elements being operatively connected with said power-driven shaft; the improvement wherein said first drive element is a first belt pulley affixed to said power-driven shaft and said second drive element is a second belt pulley affixed to said power-driven shaft; the improvement further comprising an endless first transmission belt trained about said first belt pulley and said coiler head for torque-transmittingly connecting said power-driven shaft with said coiler head; a third belt pulley coaxially and rigidly connected with one of said pressure rollers; and an endless second transmission belt trained about said second and third belt pulleys for torque-transmittingly connecting said power-driven shaft with said one pressure roller.

4. A sliver coiler as defined in claim 3, wherein said further comprising an idling pulley means for tensioning said endless first transmission belt.

5. A sliver coiler as defined in claim 3, further comprising a fourth belt pulley coaxially and rigidly connected with the other of said pressure rollers; said endless second transmission belt coupling said second belt pulley with said fourth belt pulley for torque-transmittingly connecting said power-driven shaft with both pressure rollers by said endless second transmission belt.

6. A sliver coiler as defined in claim 3, wherein said further wherein said sliver coiler includes a rotatably held platform situated underneath said coiler head at a vertical distance therefrom for supporting a coiler can into which sliver running downwardly from said coiler head is deposited; further comprising a third drive element mounted on said power-driven shaft and a transmission element operatively connecting said third drive element with said rotary platform.

7. A sliver coiler as defined in claim 3, wherein at least one of said endless transmission belts is a toothed transmission belt and the belt pulleys associated therewith are of the sprocket type and are in a meshing relationship therewith.

* * * * *